US007810191B2

(12) United States Patent
Littlehorn et al.

(10) Patent No.: US 7,810,191 B2
(45) Date of Patent: Oct. 12, 2010

(54) BODY SUPPORT PILLOW AND METHODS

(75) Inventors: Sheila Littlehorn, Littleton, CO (US); Catherine McNeil, Golden, CO (US)

(73) Assignee: The Boppy Company, Golden, CO (US)

( * ) Notice: Subject to any disclaimer, the term of this patent is extended or adjusted under 35 U.S.C. 154(b) by 33 days.

(21) Appl. No.: 12/324,201

(22) Filed: Nov. 26, 2008

(65) Prior Publication Data

US 2009/0094749 A1 Apr. 16, 2009

Related U.S. Application Data

(62) Division of application No. 11/238,879, filed on Sep. 28, 2005, now Pat. No. 7,472,443.

(51) Int. Cl.
*A47C 21/00* (2006.01)

(52) U.S. Cl. ..... 5/632; 5/630; 5/652

(58) Field of Classification Search ..... 5/630, 5/632, 646, 648, 652
See application file for complete search history.

(56) References Cited

U.S. PATENT DOCUMENTS 682,871 A 9/1901 Hogan et al.
1,343,357 A 6/1920 Eggers
2,328,871 A 9/1943 Woehler
2,961,668 A 11/1960 Hayes
3,667,074 A 6/1972 Emery
3,842,977 A * 10/1974 Hollander ..... 206/407
3,848,281 A 11/1974 Mathews
3,920,239 A 11/1975 White
4,161,794 A 7/1979 Darnfors
4,197,604 A 4/1980 Nakamura
D255,966 S 7/1980 Stadel
4,227,270 A 10/1980 Rivera
4,236,264 A 12/1980 Britzman
4,345,347 A 8/1982 Kantor
4,434,513 A 3/1984 Welch
4,624,021 A 11/1986 Hofstetter
4,731,890 A 3/1988 Roberts
4,754,510 A 7/1988 King (Continued)

FOREIGN PATENT DOCUMENTS

DE 42 05 650 A1 11/1993

(Continued)

OTHER PUBLICATIONS

U.S. Appl. No. 10/927,404, filed Aug. 25, 2004, Littlehorn.

(Continued)

*Primary Examiner*—Fredrick Conley
(74) *Attorney, Agent, or Firm*—Townsend and Townsend and Crew LLP

(57) ABSTRACT

In one embodiment, a pillow is constructed of a pillow body having a top portion, a middle portion, and a bottom portion. The top portion has a curved end and two curved sides that are generally parallel to each other. The middle portion is generally cylindrical in geometry. The bottom portion includes an enlarged section that flares outward from the middle portion. The bottom portion may also include a curved central section and narrow end section having a curved end.

15 Claims, 5 Drawing Sheets

U.S. PATENT DOCUMENTS

| | | | | |
|---|---|---|---|---|
| 4,858,259 | A | 8/1989 | Simmons et al. | |
| 4,901,384 | A | 2/1990 | Eary | |
| D315,845 | S | 4/1991 | Lafley | |
| 5,029,350 | A | 7/1991 | Edelson | |
| D318,969 | S | 8/1991 | Byrn | |
| 5,056,533 | A | 10/1991 | Solano | |
| 5,134,740 | A | 8/1992 | Summer | |
| 5,154,649 | A | 10/1992 | Pender | |
| 5,193,235 | A | 3/1993 | Kircher | |
| 5,257,429 | A | 11/1993 | Genis | |
| 5,261,134 | A | 11/1993 | Mathews | |
| 5,297,304 | A * | 3/1994 | O'Sullivan | 5/630 |
| 5,313,678 | A | 5/1994 | Redewill | |
| D348,174 | S | 6/1994 | Genis | |
| D352,633 | S | 11/1994 | Berggren | |
| D360,554 | S | 7/1995 | Righini | |
| 5,515,563 | A | 5/1996 | Chao | |
| 5,519,906 | A | 5/1996 | Fanto-Chan | |
| 5,546,620 | A | 8/1996 | Mathews | |
| 5,581,833 | A | 12/1996 | Zenoff | |
| D377,881 | S | 2/1997 | Watt | |
| 5,661,861 | A | 9/1997 | Mathews | |
| 5,702,153 | A | 12/1997 | Pliska | |
| D393,772 | S | 4/1998 | Vingino | |
| 5,790,999 | A | 8/1998 | Clark | |
| D416,159 | S | 11/1999 | Porter | |
| 5,978,990 | A | 11/1999 | Akey | |
| 5,979,981 | A | 11/1999 | Dunne et al. | |
| 5,987,674 | A | 11/1999 | Schaffner et al. | |
| 6,038,720 | A | 3/2000 | Mathews et al. | |
| 6,052,848 | A | 4/2000 | Kelly | |
| 6,055,687 | A | 5/2000 | Mathews | |
| 6,202,232 | B1 | 3/2001 | Andrei | |
| 6,233,767 | B1 | 5/2001 | Horowitz | |
| 6,279,185 | B1 | 8/2001 | Mathews | |
| 6,321,403 | B1 | 11/2001 | Mathews | |
| 6,354,665 | B1 | 3/2002 | Ross | |
| 6,394,554 | B1 | 5/2002 | Hingle | |
| 6,412,128 | B1 | 7/2002 | Mathews | |
| 6,434,770 | B2 | 8/2002 | Mathews Brown | |
| 6,453,493 | B1 | 9/2002 | Mathews Brown | |
| 6,463,608 | B1 | 10/2002 | Moe | |
| 6,484,337 | B1 | 11/2002 | Moe et al. | |
| 6,487,737 | B1 | 12/2002 | Futagami | |
| 6,499,164 | B1 | 12/2002 | Leach | |
| 6,523,200 | B2 | 2/2003 | Brown | |
| 6,532,612 | B2 | 3/2003 | Mathews Brown | |
| 6,553,590 | B1 | 4/2003 | Leach | |
| 6,564,408 | B2 | 5/2003 | Van Vuuren | |
| 6,625,828 | B2 | 9/2003 | Brown | |
| 6,640,977 | B2 | 11/2003 | Matthews Brown et al. | |
| 6,651,282 | B1 | 11/2003 | Skoug et al. | |
| 6,658,681 | B2 | 12/2003 | Britto et al. | |
| 6,668,404 | B2 | 12/2003 | Lanteri | |
| 6,671,908 | B2 | 1/2004 | Brown et al. | |
| 6,685,024 | B1 | 2/2004 | Matthews | |
| 6,711,770 | B1 | 3/2004 | Owens et al. | |
| 6,751,817 | B1 | 6/2004 | Leach | |
| 6,760,934 | B1 | 7/2004 | Leach | |
| 6,763,539 | B1 | 7/2004 | Bartley et al. | |
| 6,842,925 | B1 | 1/2005 | Owens et al. | |
| 6,857,150 | B2 | 2/2005 | Matthews Brown et al. | |
| D503,062 | S | 3/2005 | Nash | |
| 6,874,183 | B1 * | 4/2005 | Taylor | 5/632 |
| 6,944,898 | B2 | 9/2005 | Matthews Brown et al. | |
| 2002/0014436 | A1 | 2/2002 | Mathews Brown | |

FOREIGN PATENT DOCUMENTS

| | | |
|---|---|---|
| EP | 1 306 034 A1 | 5/2003 |
| FR | 1.430.355 | 1/1966 |
| FR | 2 379 268 | 9/1978 |
| GB | 215848 | 5/1924 |
| GB | 1 508 809 | 4/1978 |
| GB | 2 198 341 A | 6/1988 |
| GB | 2 205 236 A | 12/1988 |
| WO | WO 02/21978 A2 | 3/2002 |
| WO | WO 02/21979 A1 | 3/2002 |
| WO | WO 02/28232 A1 | 4/2002 |

OTHER PUBLICATIONS

U.S. Appl. No. 11/169,600, filed Jun. 28, 2005, Littlehorn et al.
Leachco Adjustable Nursing Pillow, http://store.yahoo.com/leachco/naturalboost.html, May 16, 2005.
Leachco, Positional Nursing Pillow, http://store.yahoo.com/leachco/13560.html, May 16, 2005.
Leachco Infant Support Cushion, http:/;/store.yahoo.com/leachco/lecuddler.html, Apr. 20, 2005.
Baby Supercenter, Deluxe Nurse 'N Play Pillow, http://www.babysupercenter.com/cgi-bin/webc.cgi/st_prod.html?p_prodid=13407&p_catid=&sid=5dy8u., Apr. 20, 2005.
Parents of Invention, Nurse n' Sleep, http://www.parentsofinvention.com/products/NurseSleep.htm., Apr. 20, 2005.
Simplicity for Children, Hugger with Vibration, http://www.simplicityforchildren.com/ourproducts/nursingpillows/9300PGH.htm, Apr. 20, 2005.
Touch for Life, Regular Hugster, http://www.touchforlife.biz/products/family/hugster.html, Apr. 20, 2005.
Luvee Baby Products, The Luvee Nursing Pillow, http://www.theluvee.com/, Apr. 20, 2005.
Luvee Baby Products, Nursing Pillow, http://www.theluvee.com/benefits.htm, Apr. 20, 2005.
My Brest Friend, Nursing Pillow, http://www.mybrestfriend.com/features.html, Apr. 20, 2005.
Peaceful Pea, The Nursing Nest, http://www.peacefulpea.com/nursing_nest.html, Apr. 20, 2005.
Pregnancy Store, Kozy Kushion Nursing Pillow, http://www.pregnancystore.com/kozy_kushion.htm, May 16, 2005.
Hammacher Schlemmer, Total Body Support Pillow, http://www.hammacher.com/publish/62341.asp?promo=search.
Snoozer Body Pillows for adults, www.snoozer.com/whySnoozer.asp.
U.S. Appl. No. 10/957,404, published Aug. 25, 2004, Littlehorn.
U.S. Appl. No. 11/169,600, published Jun. 28, 2005, Littlehorn et al.
Leachco Adjustable Nursing Pillow, http://store.yahoo.com/leachco/naturalboost.html, May 16, 2005.
Leachco, Positional Nursing Pillow, http://store.yahoo.com/leachco/13560.html, May 16, 2005.
Leachco Infant Support Cushion, http:/;/store.yahoo.com/leachco/lecuddler.html, Apr. 20, 2005.
Baby Supercenter, Deluxe Nurse 'N Play Pillow, http://www.babysupercenter.com/cgi-bin/webc.cgi/st_prod.html?p_prodid=13407&p_catid=&sid=5dy8u., Apr. 20, 2005.
Parents of Invention, Nurse n' Sleep, http://www.parentsofinvention.com/products/NurseSleep.htm., Apr. 20, 2005.
Simplicity for Children, Hugger with Vibration, http://www.simplicityforchildren.com/ourproducts/nursingpillows/9300PGH.htm, Apr. 20, 2005.
Touch for Life, Regular Hugster, http://www.touchforlife.biz/products/family/hugster.html, Apr. 20, 2005.
Luvee Baby Products, The Luvee Nursing Pillow, http://www.theluvee.com/, Apr. 20, 2005.
Luvee Baby Products, Nursing Pillow, http://www.theluvee.com/benefits.htm, Apr. 20, 2005.
My Brest Friend, Nursing Pillow, http://www.mybrestfriend.com/features.html, Apr. 20, 2005.
Peaceful Pea, The Nursing Nest, http://www.peacefulpea.com/nursing_nest.html, Apr. 20, 2005.
Pregnancy Store, Kozy Kushion Nursing Pillow, http://www.pregnancystore.com/kozy_kushion.htm, May 16, 2005.
Hammacher Schlemmer, Total Body Support Pillow, http://www.hammacher.com/publish/62341.asp?promo=search, Nov. 26, 2008.

Moonlight Slumber, The three-in-one body pillow from Moonlight Slumber, The serenity Star, www.moonlightslumber.com, Nov. 26, 2008.
Snoozer Body Pillows for adults, www.snoozer.com/whySnoozer.asp, Jul. 7, 2005.
Sears, Body Pillow, item #09650132000, Mfr. Model #50132, Jul. 7, 2005.
Real Goods, Sleeping Bean Body Pillow, www.realgoods.com/shop/shop2.cfm/dp/205/ts/1008493, Jul. 7, 2005.
The Comfort Store, The Original Sleeping Bean Body Pillows, www.sitincomfort.com/orslbebopi.html, Jul. 7, 2005.

* cited by examiner

BODY SUPPORT PILLOW AND METHODS

This application is a divisional of U.S. patent application Ser. No. 11/238,879, filed Sep. 28, 2005, by Sheila Littlehorn et al., the entire disclosure of which is incorporated hereby by reference.

BACKGROUND OF THE INVENTION

This invention relates generally to the field of pillows and, in particular, to pillows that may be used to support various parts of the body.

Pillows exist in a variety of shapes and sizes. Perhaps the most common type of pillow is generally rectangular and is filled with natural or synthetic materials. Such pillows are traditionally designed to support a person's head while lying in bed.

Another type of pillow is generally curved and has an interior well region. Such pillows have found use in supporting babies, when nursing, when sitting among others. Such pillows are described in U.S. Pat. Nos. 5,261,134, 5,661,861, 6,038,720, 6,055,687, 6,685,024, 6,434,770, 6,671,908, 6,532,612, 6,279,185, and 6,412,128, the complete disclosures of which are herein incorporated by reference.

Yet another pillow which has one particular use for supporting a pregnant woman's stomach is described in U.S. patent application Ser. No. 10/927,404, filed Aug. 25, 2004, the complete disclosure of which is herein incorporated by reference.

Other pillows having a variety of uses are described in U.S. Pat. Nos. 6,763,539, 6,944,898, and 6,857,150 and in co-pending U.S. patent application Ser. No. 11/169,600, filed Jun. 28, 2005, the complete disclosures of which are herein incorporated by reference.

This invention is related to other types of pillows and methods for their use. These are more fully described below.

BRIEF SUMMARY OF THE INVENTION

The invention provides various pillows that may be used to simultaneously support various parts of the body. For example, the pillow may be used to support a person while lying in various positions, when sitting down, to support the feet, and the like. Further, the pillow may be arranged in a variety of configurations to support a wide variety of body positions and orientations.

In one particular embodiment, a pillow comprises a pillow body having a top portion, a middle portion, and a bottom portion. The top portion has a curved end and two curved sides that are generally parallel to each other. The middle portion is generally cylindrical in geometry and is generally perpendicular to the top portion. Further, the bottom portion includes an enlarged section that flares outward from the mid-section, along with a curved central section and a narrow end section having a curved end.

In one particular aspect, the pillow body may have a length when lying on a flat surface that is in the range from about 36 inches to about 56 inches. The top portion may have a width that is in the range from about 22 inches to about 32 inches. The bottom portion may have width in the range from about 26 inches to about 36 inches.

In one particular configuration, the top portion may be used to rest under a person's head when the person is lying on their side. In this way, the enlarged section of the lower portion supports the person's stomach, while the curved central section fits between the person's legs.

In one particular arrangement, the pillow body may comprise a fill material that is encased in the fabric shell. In some cases, a seam may be placed in the fabric shell of the middle portion to prevent the migration of the fill material past the seam. In some cases, an optional fabric cover may be disposed over the fabric shell.

One particular advantage of the pillow is that the pillow body may be generally C-shaped in geometry when lying on a flat surface. The pillow body may also be rolled into a cylindrical shape that may be placed in a cylindrical bolster. In this way, the pillow body may remain in its cylindrical shape and be used as a support pillow, such as supporting a user's feet, back, or the like. In one particular arrangement, the bolster may be constructed of a top half and a bottom half that are connected by at least one connector, such as a zipper, ties, buttons, hooks, hook and loop fasteners, snaps or the like. Also, other types of bolsters may be used with openings in other locations, such as at the top or the bottom end.

The invention also provides an exemplary method for supporting a person when lying down. The method may utilize a support pillow having a top portion, a middle portion, and a bottom portion similar to the pillow described above. The top portion is placed underneath the person's head, and the bottom portion is placed between the person's thighs. In this way, the enlarged section engages the person's mid-section. Hence, the pillow may be used to support a person's head, stomach, and legs all at the same time.

In one particular use, the person's knees may be bent, and the bottom portion may conform to the user's body such that it contacts the person's bottom. Also, the top portion may extend beyond the back of the user's head, giving the user a sizeable lateral surface on which to place the person's head.

In another particular arrangement, a person may sit on the top portion or the bottom portion of the pillow and then wrap the pillow body around the person such that the remaining portion of the pillow is on the user's lap. This may be particularly advantageous when sitting and reading, with the remaining portion supporting the reading material.

In another method, such a support pillow may be rolled into a generally cylindrical shape and then placed in a cylindrical bolster. The support pillow may then be placed behind a person's back to provide back support. In another alternative, the bolster may be placed on the floor and then used to support a person's feet when sitting down.

DETAILED DESCRIPTION OF THE INVENTION

Figure 1:
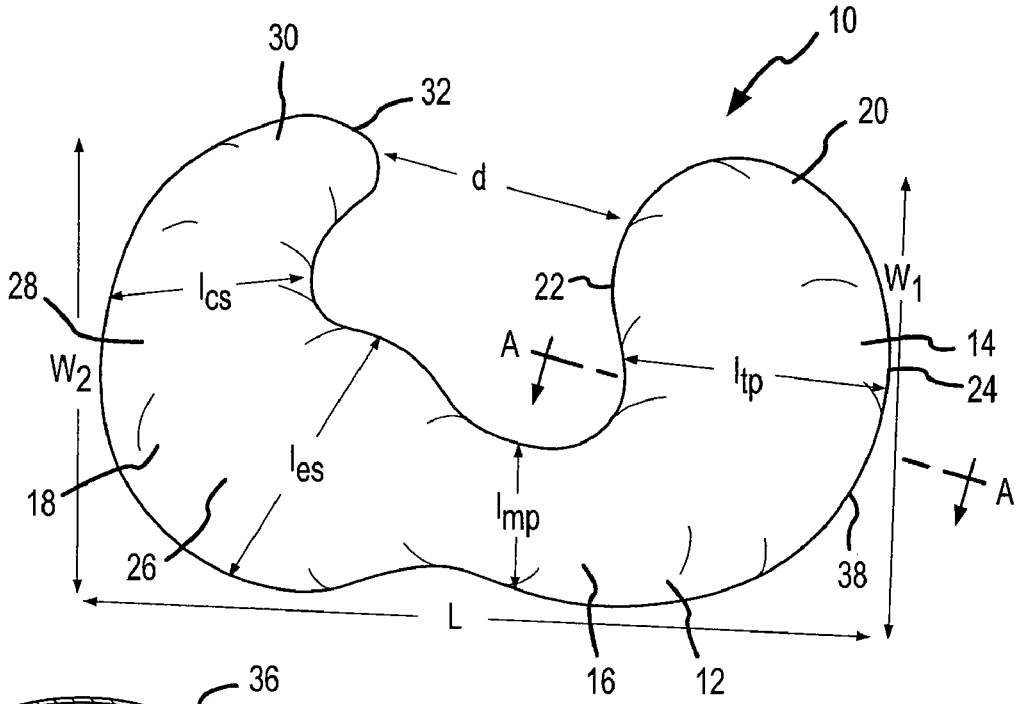
FIG. 1 is a top view of one embodiment of a pillow according to the invention.

The invention provides various body pillows and methods for their use. One particular advantage of the pillows is their shape and size. For example, in one configuration, the pillow may be somewhat C-shaped in geometry when lying on a flat surface and has various sections of differing dimension which are configured to interact with various portions of a person's body. For example, in one arrangement, part of the pillow may be used to support the front of the person's body while lying down, with the top portion supporting the head and the bottom portion being placed between the knees to align the hips. Such a pillow may find particular use with a pregnant woman, where the middle portion can be placed under the pregnant woman's belly to provide support, while the bottom portion serves to align the hips. In this way, the pregnant woman may lay on her side in a comfortable position while being supported by the pillow. It will be appreciated, however, that such a pillow may be used with non-pregnant people as well, especially with people having back problems, those who are overweight, or who prefer to sleep on their side, among others.

Another particular use for such a pillow is that it may be used with a person in a sitting position, with one end of the pillow being placed behind the person's back while the other end is folded around the mid-section and used as a support cushion on the person's lap to hold a book, reading materials, games, and the like. As another option, the entire pillow may be rolled and placed in a bolster cover which may then be placed behind a person's back while in a sitting position, such as while reading in bed, or under the feet while sitting in a chair. In this way, the pillow may be used as a soft foot pillow to elevate the person's legs.

The pillow may conveniently be comprised of a resilient cushioned body which may be constructed of a fill material, such as a polyester filling, that is encased within a fabric shell. Other kinds of materials may be used, however, including, polybeads, natural materials, feathers, inflatable bladders, fluids, and the like. In some cases, a removable slipcover which fits snugly around the shape of the pillow body may be provided. This slipcover may have one or more openings that allow the pillow to slide into it. Further, one or more fasteners may be used to close these openings, such as zippers, ties, snaps, a hook and loop fastener material, and the like.

For storage, a separate bolster cover may be used and, in one embodiment, may be cylindrical in geometry. The bolster may be formed in two halves so that the rolled pillow may easily fit within the bolster. A zipper, snap, ties, or the like may be used to close the two halves shut when the pillow is inside.

In one option, both ends of the pillow (the top section and the bottom section) may have rounded ends. This makes the pillow more aesthetically appealing and makes it so that the pillow may be more easily rolled. The pillow may also have a firmness that permits it to be soft and malleable so that it can be formed to the individual comfort of the user, yet firm enough so that it provides adequate support.

Figure 1A:
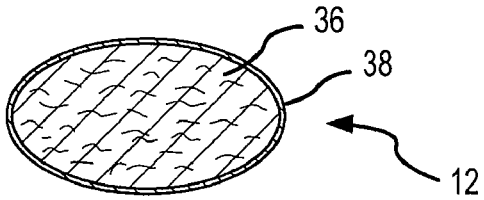
FIG. 1A is a cross-sectional view of the pillow of FIG. 1.
Figure 2:
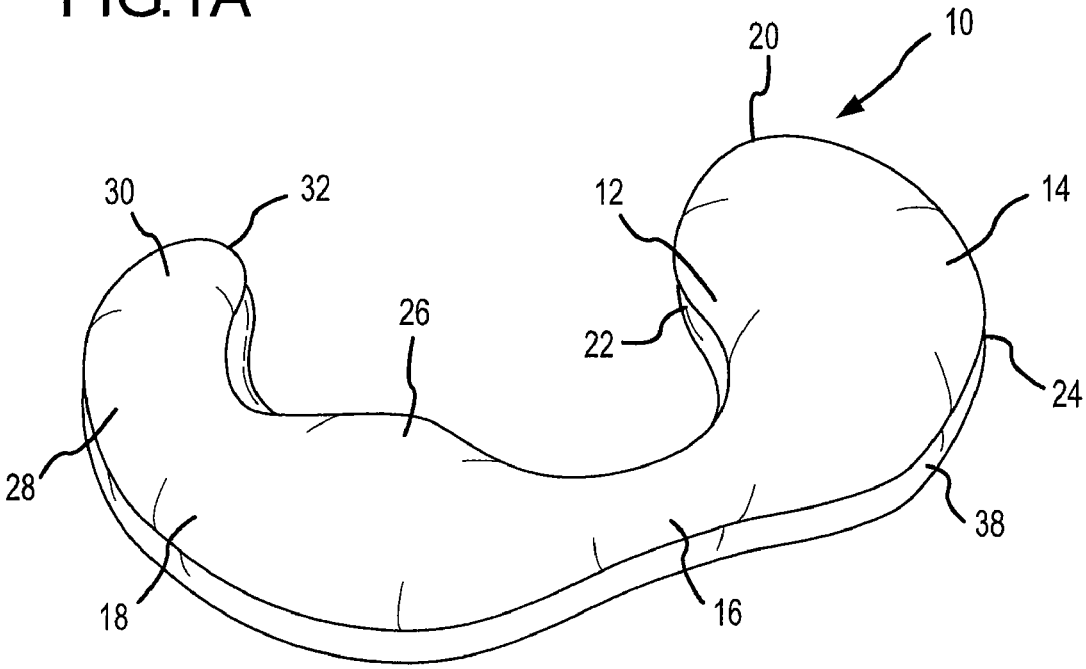
FIG. 2 is a perspective view of the pillow of FIG. 1.

Referring now to the drawings, one exemplary embodiment of a pillow 10 will be described in greater detail. As best illustrated in FIGS. 1, 1A and 2, pillow 10 comprises a pillow body 12 having a top portion 14, a middle portion 16, and a bottom portion 18. Top portion 14 comprises a curved end 20 and two curved sides 22 and 24 which are generally parallel to each other. Middle portion 16 is generally cylindrical in geometry and is generally perpendicular to top portion 14. Bottom portion 18 includes an enlarged section 26 that flares out from middle portion 16 and then flows into a curved central section 28 and a narrow end section 30 having a curved end 32.

In one particular arrangement, top portion 14 may be used as a traditional pillow to support a person's head. Also, when the person is lying on their side, enlarged section 26 may be used to support the person's stomach while bottom portion 18 is placed between the user's legs to align their thighs and hips.

In one particular arrangement where pillow 10 is used as a body pillow in a manner similar to that described above, pillow 10 may have a length L that is in the range from about 36 inches to about 66 inches and, more preferably, from about 42 inches to about 50 inches and, in some cases, about 46 inches. Top portion 14 may be generally perpendicular to middle portion 16 and may have a width W1 that is the range from about 18 inches to about 32 inches and, in some cases, from about 24 inches to about 30 inches and, in some cases, about 27 inches. Bottom portion 18 follows a generally continuous curve and also has a width $W_2$ that may be in the range from about 22 inches to about 36 inches and, in some cases, from about 28 inches to about 35 inches and, in other cases, about 31 inches. The vertical height of pillow 10 when lying on a flat surface may be in the range from about 3 inches to about 12 inches and, more preferably, from about 4 inches to about 9 inches.

As illustrated in FIG. 1, when lying on a flat surface, pillow 10 is generally C-shaped in geometry. It will be appreciated, however, that pillow 10 may be easily manipulated into other shapes and configurations, especially since middle portion 16 is narrow and may be easily bent at that point. Further, the entire pillow 10 may be constructed of a resilient and flexible material so that pillow 10 may be folded, bent, or otherwise arranged into a variety of configurations.

Other dimensions of pillow 10 which may make it particularly useful for supporting a person when lying on their side are a length $l_{tp}$ of the top portion 14 that is in the range from about 10 inches to about 20 inches and, more preferably, from about 14 inches to about 18 inches. Middle portion 16 may have a length $l_{mp}$ that is in the range from about 4 inches to about 12 inches and, more preferably, from about 6 inches to about 10 inches. This may also be the diameter of the middle portion. The enlarged section 26 may have a length $l_{es}$ that is in the range from about 10 inches to about 20 inches and, more preferably, from about 14 inches to about 18 inches. Also, central curved section 28 of bottom portion 20 may have a length $l_{cs}$ that is in the range from about 6 inches to about 16 inches and, more preferably, from about 8 inches to about 10 inches. In one uncontorted position, as illustrated in FIG. 1, the distance d between ends 20 and 30 may be in the range from about 14 inches to about 32 inches and, more preferably, from about 20 inches to about 26 inches.

As best shown in FIG. 1A, pillow body 12 may be constructed of a fill material 36 that is encased within a fabric shell 38 (see also FIG. 1). Fill material 36 may be constructed of essentially any type of resilient material, such as polyester fibers, polybeads, feathers, seeds, beans, and the like. Optionally, fill material 36 could comprise a fluid, such as air, that is enclosed within an inflatable bladder. Fabric shell 38 may comprise essentially any type of fabric, such as a cotton fabric, polyester fabric, nylon fabric, or the like. Techniques for constructing pillow body 12 may be similar to those described in U.S. Pat. Nos. 5,261,134, 5,661,861, 6,038,720, 6,055,687, 6,685,024, 6,434,770, 6,671,908, 6,532,612, 6,279,185, and 6,412,128, and co-pending U.S. patent application Ser. No. 10/769,007, filed Jan. 29, 2004, the complete disclosures of which are herein incorporated by reference.

Figure 3:
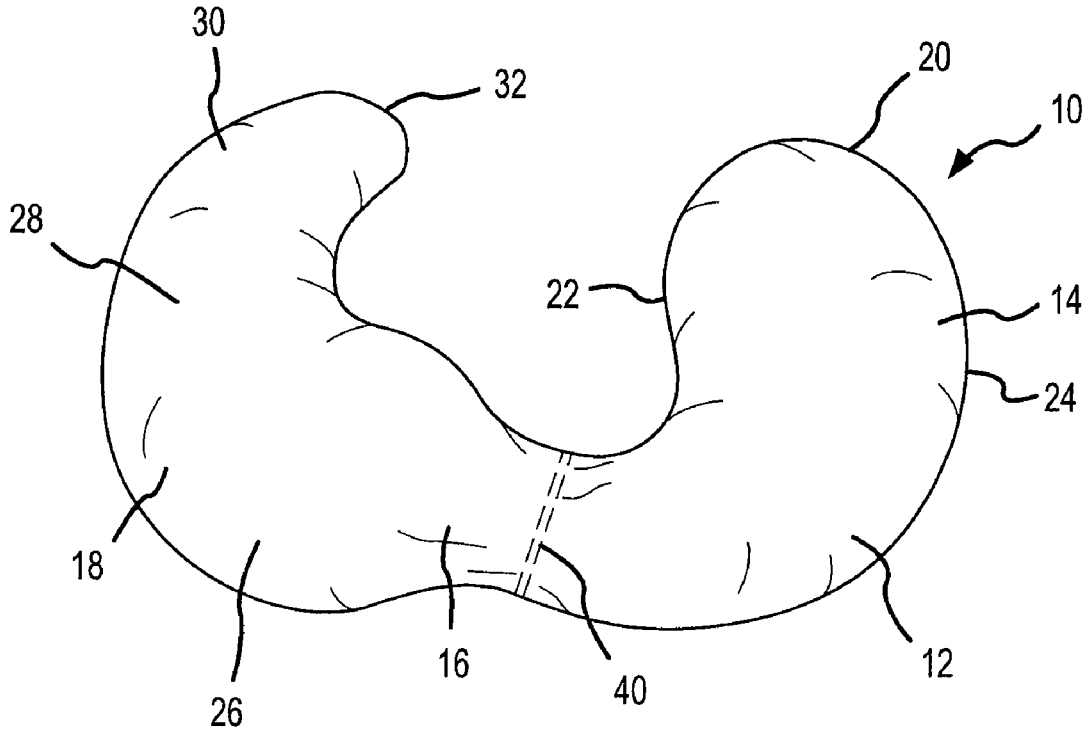
FIG. 3 illustrates the pillow of FIG. 1 with an optional seam in a middle portion according to the invention.

Referring now to FIG. 3, pillow 10 may optionally include a seam 40 that extends across middle portion 16. Seam 40 may simply be a sewn line that extends across middle portion 16 and connects the top and bottom of fabric shell 38. Seam 40 is used to prevent the fill material from migrating between the top portion 14 and the bottom portion 18. In some cases, multiple seams may be placed within pillow body 12 to provide such benefits. For example, seam lines could be placed at either end of middle portion 16 in order to keep the fill material within the middle portion. As another option, one or more internal baffles or fabric walls may be placed inside shell 38 to prevent the migration of the fill material.

Pillow 10 may be conveniently stored in a cylindrical arrangement. To configure pillow 10 in a cylindrical shape, it may be rolled by folding, bending, or compressing the curved end 20 inward toward middle portion 16. Also, curved end 30 may be placed either above or below curved end 20 and also moved inward toward middle portion 16. In this way, middle portion 16 will curve and will generally follow a constant arc toward ends 20 and 32, thus forming a cylindrical configuration generally similar to that illustrated in FIG. 4.

Figure 4:
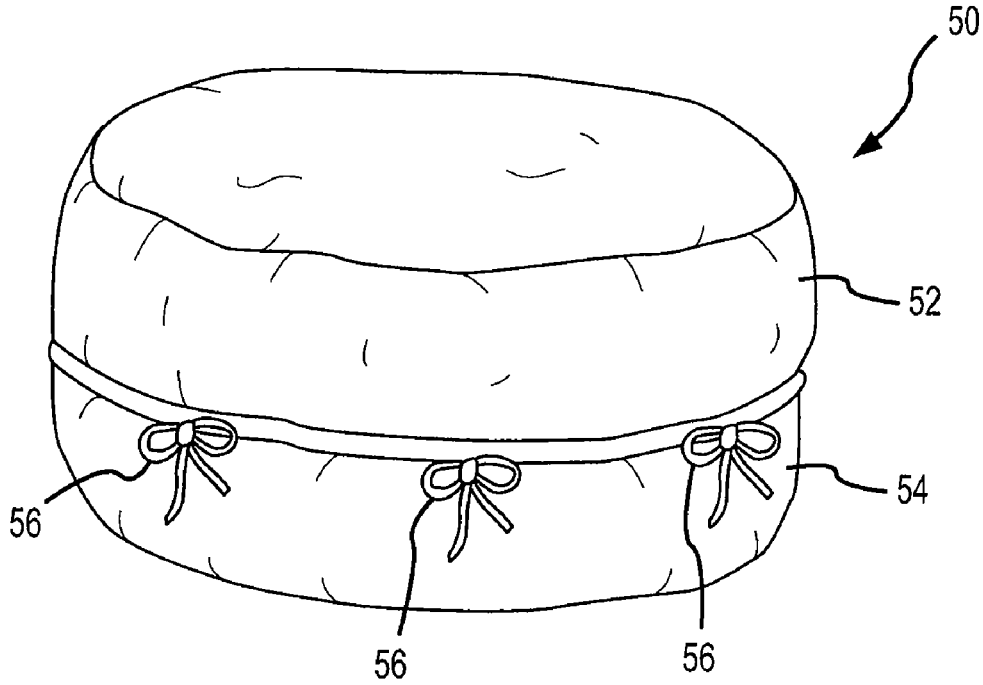
FIG. 4 illustrates the pillow of FIG. 1 when rolled into a cylinder and then held within a cylindrical bolster according to the invention.

Shown in FIG. 4 is a fabric bolster 50 into which pillow 10 has been placed. Bolster 50 comprises a top half 52 and a bottom half 54 which may be completely separate pieces or may be permanently connected along a portion of their lengths. Halves 52 and 54 may be separated to provide an opening into which pillow 10 may be placed. Halves 52 and 54 may then be folded about pillow 10 and fasteners 56 may be used to secure the two halves together. As shown, fasteners 56 comprise ties. It will be appreciated, however, that other types of fasteners may be used, such as a zipper, hooks, snaps, a hook and loop fastener material, and the like. Also, bolster 50 may be constructed such that the opening into which the pillow is placed is located at other positions. For example, the opening could be at the top end or the bottom end, such as at a top seam, or anywhere along the sides. A variety of fasteners may be used to close this opening similar to those previously described.

In one arrangement, pillow 10 may be generally compressed when held within bolster 50 so that bolster 50 is generally firm and provides a support surface for resting various parts of the body. For example, bolster 50 may be placed behind a person's back when sitting down to provide support to the back. Bolster 50 may also be used as a footrest, leg rest, or the like. When ready for use, fasteners 56 may be undone, halves 52 and 54 separated, and pillow 10 removed and placed into the desired configuration.

Figure 5:
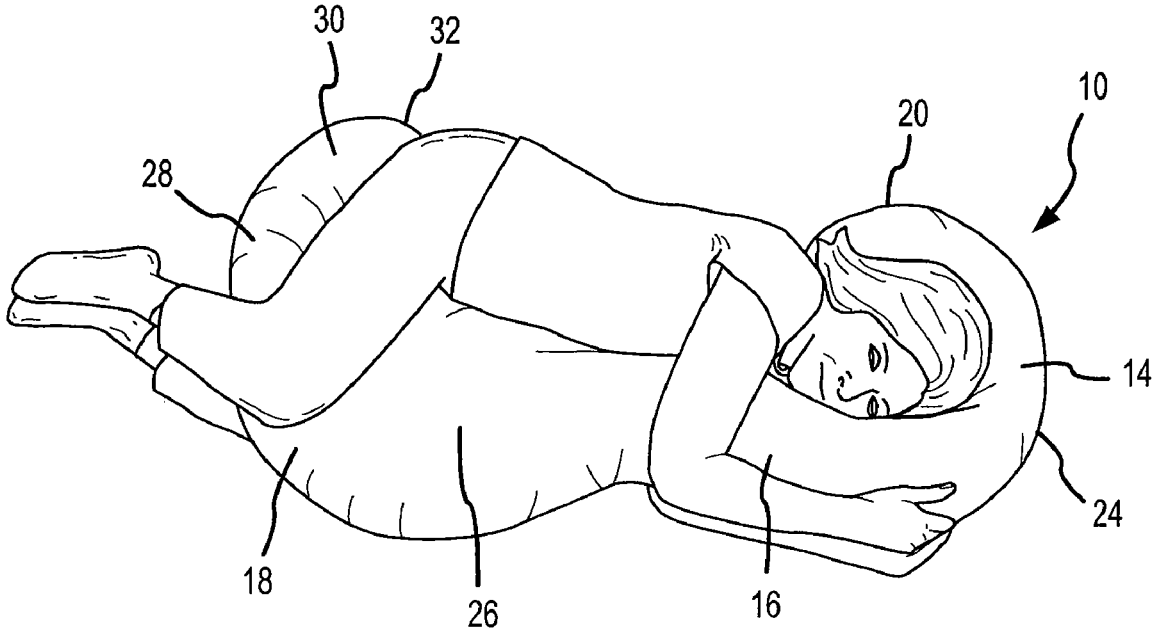
FIG. 5 is a front view of a person shown using the pillow of FIG. 1 in one particular arrangement.
Figure 6:
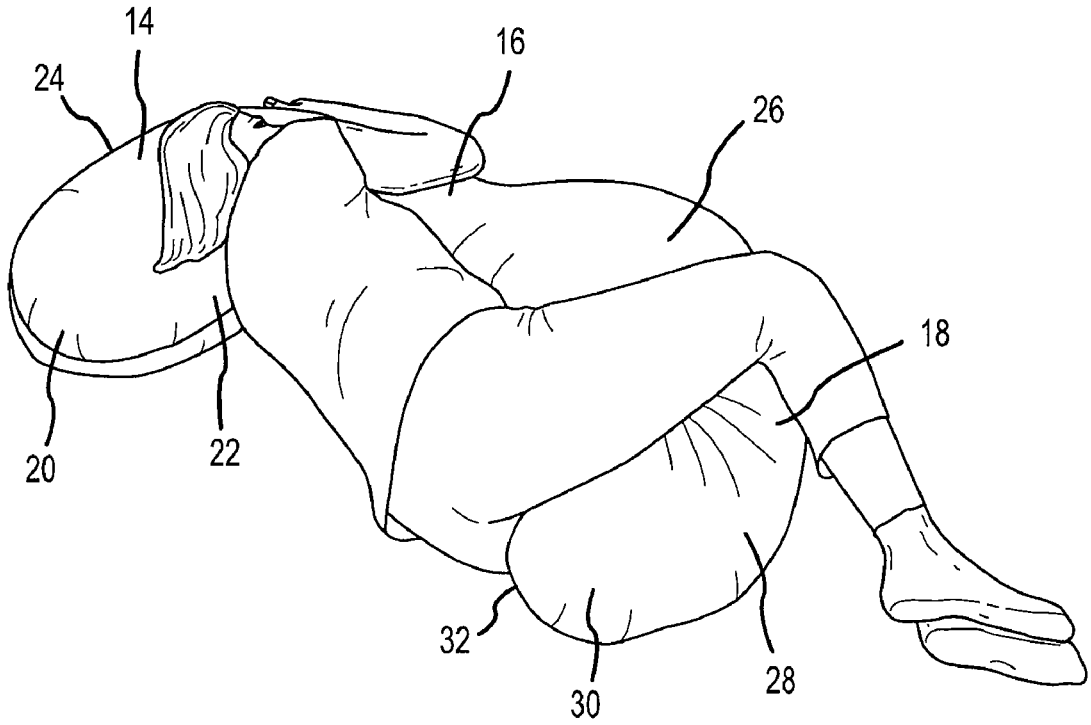
FIG. 6 illustrates the person of FIG. 5 from a rear view when using the pillow of FIG. 1.

Referring now to FIGS. 5 and 6, one particular use of pillow 10 will be described. As shown, a person is lying on their side, with pillow 10 generally conforming to the front of the user's body. More specifically, top portion 14 is placed under a person's head in a manner similar to a conventional pillow. Middle portion 16 extends generally against the user's chest and is small enough to allow the user's arms to hang over the edge of middle portion 16. Further, the generally cylindrical geometry of middle portion 16 provides a convenient resting place for the user's arms. Continuing down the body, the enlarged section 26 may be placed underneath the person's stomach to provide support to the user's front side. This may be particularly beneficial to pregnant women or people who are overweight or who need extra support in this region of their body. Just beyond enlarged section 26 is curved central section 28 which passes between the user's thighs and then wraps alongside the user's body. This permits the user's thighs to be separated, and provides both alignment and support for the user's hips while lying on their side.

Although shown in front of a person's body, it will be appreciated that pillow 10 may be used along the user's backside. Also, it will be appreciated that only certain portions of the pillow may be used at one time. For example, the person may rest their head on top portion 14, enlarged section 26, or the like without using the rest of the pillow.

Figure 7:
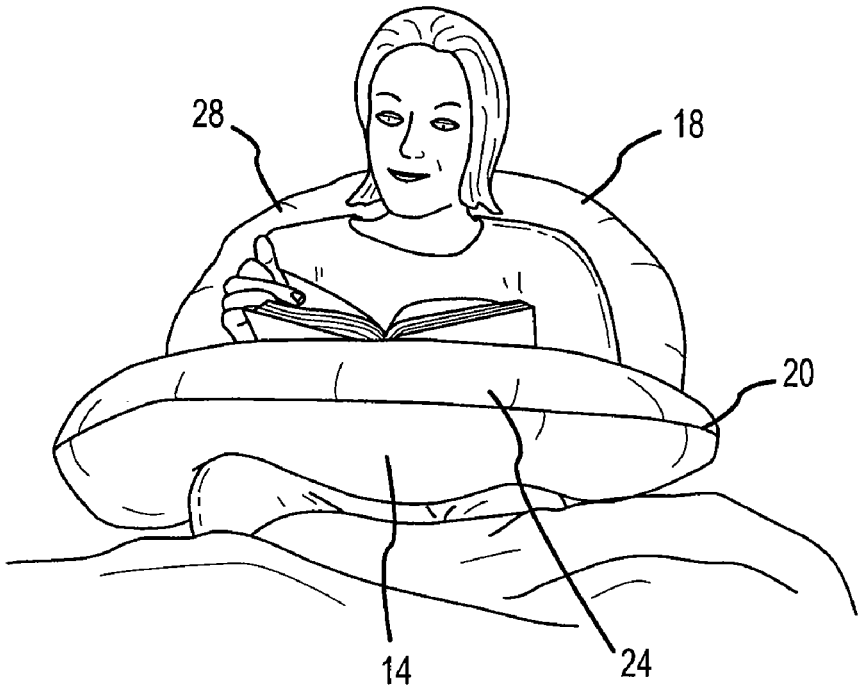
FIG. 7 illustrates a person using the pillow of FIG. 1 when reading a book.

Another particular use of pillow 10 is illustrated in FIG. 7 where bottom portion 18 is placed behind the user's back while the user is leaning against a support surface. Middle portion 16 extends along the user's side, while top portion 14 rests on the user's lap. In this way, top portion 14 may be used to provide support for reading materials, such as a book, while the user is sitting down. Also, it will be appreciated that top portion 14 may be used to provide support for a variety of other items, such as a food tray, plate, game, toy, or the like. Also, it will be appreciated that in this particular configuration, top portion 14 could be placed behind the user's back while bottom portion 18 rests on the user's lap.

Figure 8:
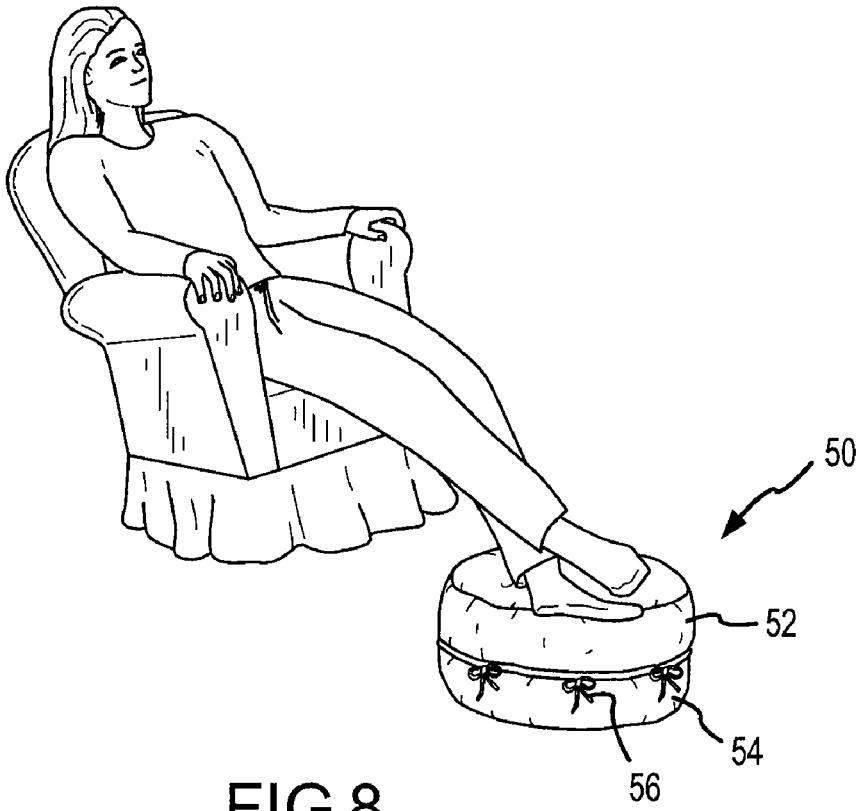
FIG. 8 illustrates the pillow and bolster of FIG. 4 when used to support a person's feet according to the invention.

FIG. 8 illustrates bolster 50 when holding pillow 10 and used as a support surface. As shown in FIG. 8, a person is sitting in a chair with their feet resting on the top of bolster 50. In this way, bolster 50 may serve as a type of footrest or ottoman. In other configurations, bolster 50 could be used to support a person's legs while lying down, to support a user's back when sitting in a chair, or the like.

Figure 9:
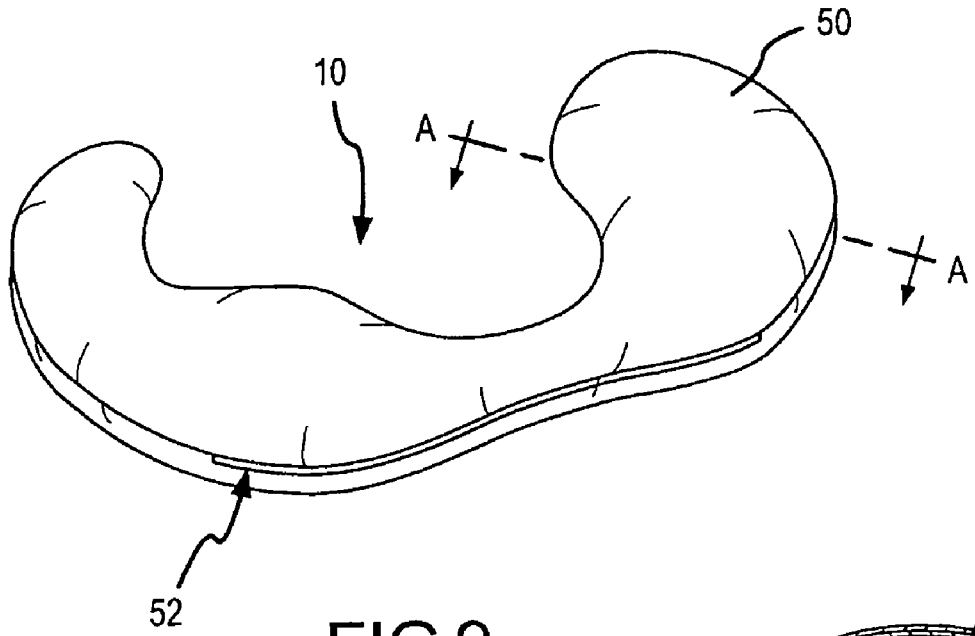
FIG. 9 illustrates the pillow of FIG. 1 with an optional slip cover.
Figure 9A:
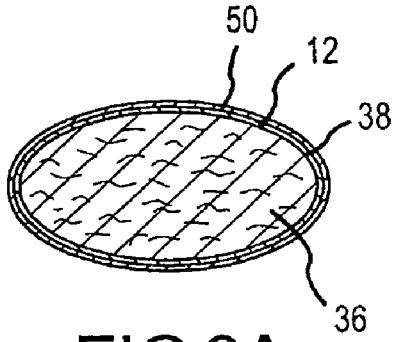
FIG. 9A is a cross sectional view of the pillow and slip cover of FIG. 9.

Optionally, as illustrated in FIGS. 9 and 9A, a removable slipcover 50 may be placed over fabric shell 38 and may generally conform to the dimensions of pillow body 12. Slipcover 50 may include one or more openings to permit it to be inserted over pillow body 12 and may include one or more fasteners for closing the openings. For instance, slipcover 50 may include a zipper 52 to close the opening, although other fasteners could be used as well, including any of those described herein. Examples of techniques used to construct slipcovers are described in U.S. Pat. Nos. 6,453,493, 6,625,828, and 6,851,143, and co-pending U.S. patent application Ser. Nos. 10/789,784, filed Feb. 27, 2004, and 11/015,708, filed Dec. 17, 2004, the complete disclosures of which are herein incorporated by reference.

Figure 10:
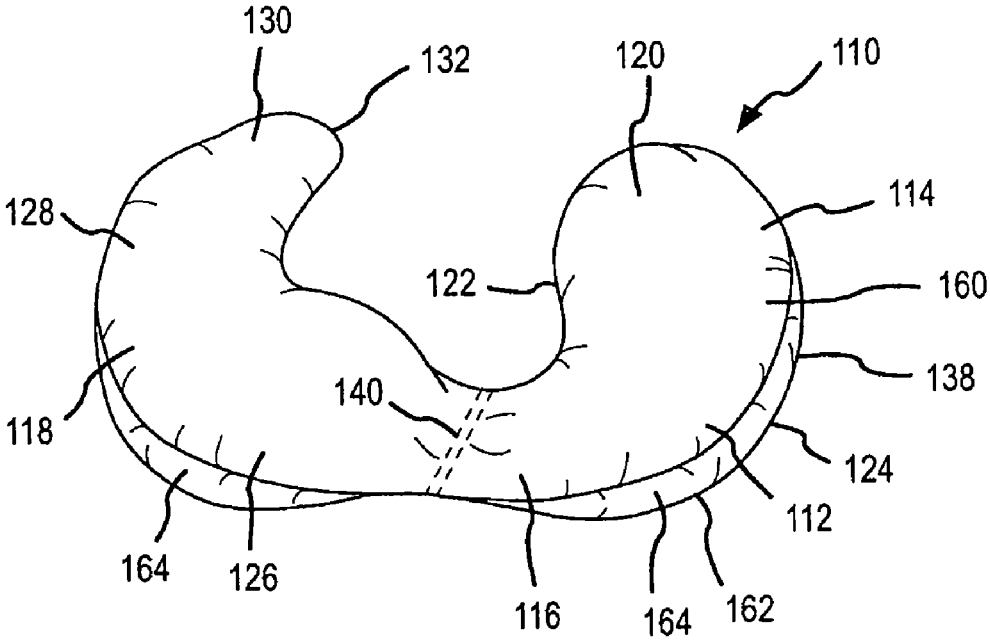
FIG. 10 is a perspective view of an alternative embodiment of a pillow according to the invention.

FIG. 10 illustrates another embodiment of a pillow 110 that is similar to pillow 10. As such, similar elements are labeled in the drawings with the same reference numeral used with FIG. 1, except that they are preceded by a "1" and are not described further. With pillow 110, pillow body 120 is constructed a cover 138 having a top piece 160, a bottom piece 162 and an outer gusset 164. These are sewn together along seam lines, with gusset 164 beginning at end 132 and proceeding to seam 140. Along its length, gusset increases and then decreases in size. From seam 140, gusset 164 again continues to end 120, increasing and decreasing in size in the same manner. At its widest portion, gusset 164 (when pillow 110 is lying flat) has height dimensions in the range from about 1 inch to about 6 inches. Gusset 164 may be used to shape pillow 110 in the configuration shown.

The invention has now been described in detail for purposes of clarity and understanding. However, it will be appreciated that certain changes and modifications may be practiced within the scope of the appended claims.

What is claimed is:

1. A method for storing a pillow, the method comprising:

providing a support pillow comprising a pillow body having a top portion, a middle portion and a bottom portion, wherein the top portion has a curved end and two curved sides that are generally parallel to each other, wherein the middle portion is generally cylindrical in geometry and is generally perpendicular to the top portion, and wherein the bottom portion includes an enlarged section that flares outward from the middle portion, a curved central section and a narrow end section having a curved end;

rolling up the support pillow; and placing the support pillow in a generally cylindrical bolster.

2. A method as in claim 1, further comprising placing the support pillow behind a person's back.

3. A method as in claim 1, further comprising placing the support pillow under a person's feet.

4. A method as in claim 1, wherein the pillow body is configured so that, when the top portion is placed underneath the person's head and the bottom section is placed between the person's thighs, the enlarged section engages the person's mid-section.

5. A method as in claim 4, wherein the pillow body is further configured so that when the person's knees are bent, the bottom portion contacts the person's bottom.

6. A method as in claim 4, wherein the pillow body is further configured so that, when the top portion is placed underneath the person's head and the bottom section is placed between the person's thighs, the top portion extends beyond the back of the user's head.

7. A method as in claim 1, wherein the pillow body comprises a fill material encased in a fabric shell, and further comprising placing a fabric cover over the fabric shell.

8. A method as in claim 7, further comprising providing a seam in the fabric shell at the middle portion to prevent the migration of the fill material past the seam.

9. A method as in claim 1, wherein the pillow body is configured so that, when the person is sitting on the top portion or the bottom portion, the pillow body is configured to wrap around the user such that a remaining portion of the pillow is on the user's lap.

10. A method as in claim 1, wherein the pillow body has a length when lying on a flat surface in the range from about 36 inches to about 66 inches.

11. A method as in claim 1, wherein the top portion has a width in the range from about 18 inches to about 32 inches.

12. A method as in claim 1, wherein the bottom portion has a width in the range from about 22 inches to about 36 inches.

13. A method as in claim 1, wherein the top portion is configured to rest under a person's head when the person is lying on a side, with the enlarged section of the lower portion supporting the person's stomach, and the curved central section fits between the person's legs.

14. A method as in claim 1, wherein the bolster comprises a top half and a bottom half that are connected by at least one connector.

15. A method for storing a pillow, the method comprising:

providing a support pillow comprising:

a pillow body having a top portion, a middle portion and a bottom portion, wherein the pillow body is generally C-shaped, having a first terminal end and a second terminal end, the top portion has a curved end and two curved sides that are generally parallel to each other, the curved end of the top portion being at the first terminal end of the pillow body, the middle portion is generally cylindrical in geometry and is generally perpendicular to the top portion, and the bottom portion includes an enlarged section that flares outward from the middle portion and is configured to support a person's stomach when the person is lying on a side, a narrow end section having a curved end, the narrow section being narrower than the enlarged section and located at the second terminal end of the pillow body, and a curved central section, between the narrow end section and the enlarged section, that provides a generally continuous curve such that the narrow end section extends in a direction substantially perpendicular to the enlarged section and such that the second terminal end of the pillow body points in a direction substantially perpendicular to the direction of the first terminal end of the pillow body, the curved central section being configured to fit between the person's thighs and wrap alongside the person's body when the person is lying on the side to improve alignment and support of the person's hips;

rolling up the support pillow; and placing the support pillow in a generally cylindrical bolster.

* * * * *